US005482593A

United States Patent [19]

Kuhn et al.

[11] Patent Number: 5,482,593

[45] Date of Patent: Jan. 9, 1996

[54] HIGH SPEED APPLICATOR FOR ADHESIVE TAPE

[75] Inventors: Gary K. Kuhn, Scandia; Herbert A. McLees, Cottage Grove, both of Minn.

[73] Assignee: Minnesota Mining and Manufacturing Company, St. Paul, Minn.

[21] Appl. No.: 222,854

[22] Filed: Apr. 5, 1994

[51] Int. Cl.[6] ..... B32B 31/00

[52] U.S. Cl. ..... 156/521; 156/361; 156/540

[58] Field of Search ..... 156/519, 521, 156/540, 542, 252, 257, 268, 355, 361

[56] References Cited

U.S. PATENT DOCUMENTS

| | | | |
|---|---|---|---|
| 2,291,841 | 8/1942 | Staude | 93/61 |
| 2,723,604 | 11/1955 | Fischer | 93/61 |
| 2,990,081 | 6/1961 | De Neue et al. | 216/21 |
| 3,048,088 | 8/1962 | Fischer et al. | 93/36 |
| 3,311,032 | 3/1967 | Lucas | 93/1 |
| 3,355,995 | 12/1967 | Borkmann et al. | 93/1 |
| 3,445,314 | 5/1969 | Crim | 156/521 |
| 3,750,511 | 8/1973 | Toensing | 83/337 |
| 3,835,756 | 9/1974 | Bosse | 93/8 WA |
| 4,061,527 | 12/1977 | Traise | 156/519 |
| 4,909,885 | 3/1990 | Swenson | 156/264 |
| 4,980,011 | 12/1990 | Gruber et al. | 156/542 X |
| 5,256,239 | 10/1993 | Voltmer et al. | 156/361 X |

*Primary Examiner*—James Engel
*Attorney, Agent, or Firm*—Kinney & Lange

[57] ABSTRACT

An apparatus for and a method of applying adhesive tape to a moving web of material is disclosed. The apparatus includes a tape supply for supplying the adhesive tape and attached tape liner. A tension roller maintains a substantially constant tension in the adhesive tape and the tape liner, while a drive roller drives the adhesive tape and the tape liner. A cutting device cuts the adhesive tape away from the tape liner into a strip of tape, the strip of tape having a predetermined length. A vacuum wheel receives the strip of tape and supplies the strip of tape to the moving web of material which is forced into contact with the vacuum wheel by a jump roller. A liner rewind roller receives the tape liner.

34 Claims, 4 Drawing Sheets

HIGH SPEED APPLICATOR FOR ADHESIVE TAPE

REFERENCE TO CO-PENDING APPLICATION

Reference is made to the following co-pending U.S. patent application: Ser. No. 08/222,857, filed on even date herewith, entitled VACUUM WHEEL APPLICATOR WITH NON-CONTACT MANIFOLD, by Gary K. Kuhn and Robert L. Weber, and assigned to the same assignor as the present application.

BACKGROUND OF THE INVENTION

The present invention relates to a method of and an apparatus for applying sheets of material to a moving surface, and in particular to a high speed tape applicator for applying adhesive tape to a moving web of material.

Devices are known for severing predetermined lengths of tape on machines and applying the lengths of tape to a web of material in continuous motion. One such device is disclosed in the U.S. Pat. No. 2,990,081 to R. P. DeNeui et al., entitled APPLICATION OF TAPE TO MOVING OBJECTS, assigned to the same assignor of the present application. That device comprises a rotatably mounted tape-applying wheel and a vacuum operative within the tape-applying wheel to hold the severed length of tape against the peripheral surface of the tape-applying wheel. The tape is transferred to an article when the article and the wheel bear against each other at a tape-applying station with the tape between them. The device for severing the length of tape includes a device which presses the cutting edge of a knife against a planar surface on the peripheral of the tape-applying wheel to sever the length of tape from a tape feed moving between the knife and the tape-applying wheel. While the severing device is suitable for severing adhesive coated material at relatively low speeds, this device presents certain undesirable adjustment and maintenance problems. First, a high force must be exerted by each cutting edge against the surface of the tape-applying wheel to sever the tape. Second, the machine must be precisely constructed to afford accurate positioning of the knives, and periodic adjustment is required to compensate for wear of the cutting edges and of the tape-applying wheel. Third, it is not suitable for high speed web movement.

In addition to the above-mentioned difficulties, pressure-sensitive adhesive tapes, which have traditionally been applied to moving webs of material, frequently adhere to adjacent layers of tape on the tape supply rollers, making consistent and reliable unwinding difficult. One approach to solving this problem has been to use heat sensitive adhesive tape in lieu of the pressure sensitive adhesive tape, since such tape does not adhere to adjacent layers unless heated.

U.S. Pat. No. 4,909,885 to Swenson, is entitled APPARATUS AND METHOD FOR APPLYING HEAT-SENSITIVE ADHESIVE TAPE TO A WEB MOVING AT HIGH SPEED and is assigned to the same assignor as the present application. This patent discloses an apparatus for applying heat sensitive adhesive tape of the type having a layer of heat sensitive adhesive material that is tacky at an elevated temperature substantially greater than room temperature but not tacky at room temperature to a web of material. However, the high temperatures required to apply the tape can cause the tape, or the web to which the tape is being applied, to become overly softened, thereby losing its integrity and stretching or tearing during application of the tape.

In prior devices, the adhesive tape is held against the tape-applying wheel by a vacuum and then cut directly on the tape-applying wheel. To provide space between the various cut pieces of adhesive tape attached to the vacuum wheel, the devices include a feed roller. During operation, the teed roller is constantly moving in conjunction with the cutting device, thereby spacing the adhesive tape segments along the tape-applying wheel. The vacuum holds the adhesive tape fed to the applying wheel in a sliding arrangement with the circumferential surface of the tape-applying wheel, thereby preventing the adhesive tape from tearing. Without the combination of the feed roller and the vacuum, the segments of adhesive tape could not both be held in radial alignment with the tape-applying wheel and spaced along the tape-applying wheel.

A need exists for a method of and a device for applying adhesive tape to a web of material while the material is moving at high rates of speed, e.g. above 1,000 linear feet per minute.

SUMMARY OF THE INVENTION

A method of and a device for applying adhesive tape to a moving web of material is disclosed. The method includes supplying the adhesive tape and a tape liner to a generally smooth surface. An end of the smooth surface forms a separating surface to separate the tape liner from the adhesive tape. The adhesive tape is applied to a vacuum wheel rotating in a first direction. A precision cutting means severs at least a portion of the adhesive tape on the generally smooth surface to create a strip of tape having a predetermined length, while the tape liner remains unsevered. The strip of tape advances onto the vacuum wheel, and the rotation of the vacuum wheel is reversed. The web of material moving under the vacuum wheel is forced into contact with the vacuum wheel, thereby permitting the strip of tape to be applied to the web or material. After the strip of tape has been applied to the web of material, the moving web of material is disengaged from the vacuum wheel.

The device for applying adhesive tape to a moving web of material includes a tape supply for supplying the adhesive tape and attached tape liner. A constant tension roller maintains constant tension on the adhesive tape and the tape liner, while a drive roller drives the adhesive tape and the tape liner. A cutting means cuts the adhesive tape away from the tape liner into a strip of tape, the strip of tape having a predetermined length. Separator means separates the tape liner from the adhesive tape. A vacuum wheel receives the strip of tape and supplies the strip of tape to the moving web of material which is forced into contact with the vacuum wheel by a jump roller. A liner rewind roller receives the tape liner.

DETAILED DESCRIPTION OF THE PREFERRED EMBODIMENTS

Figure 1:
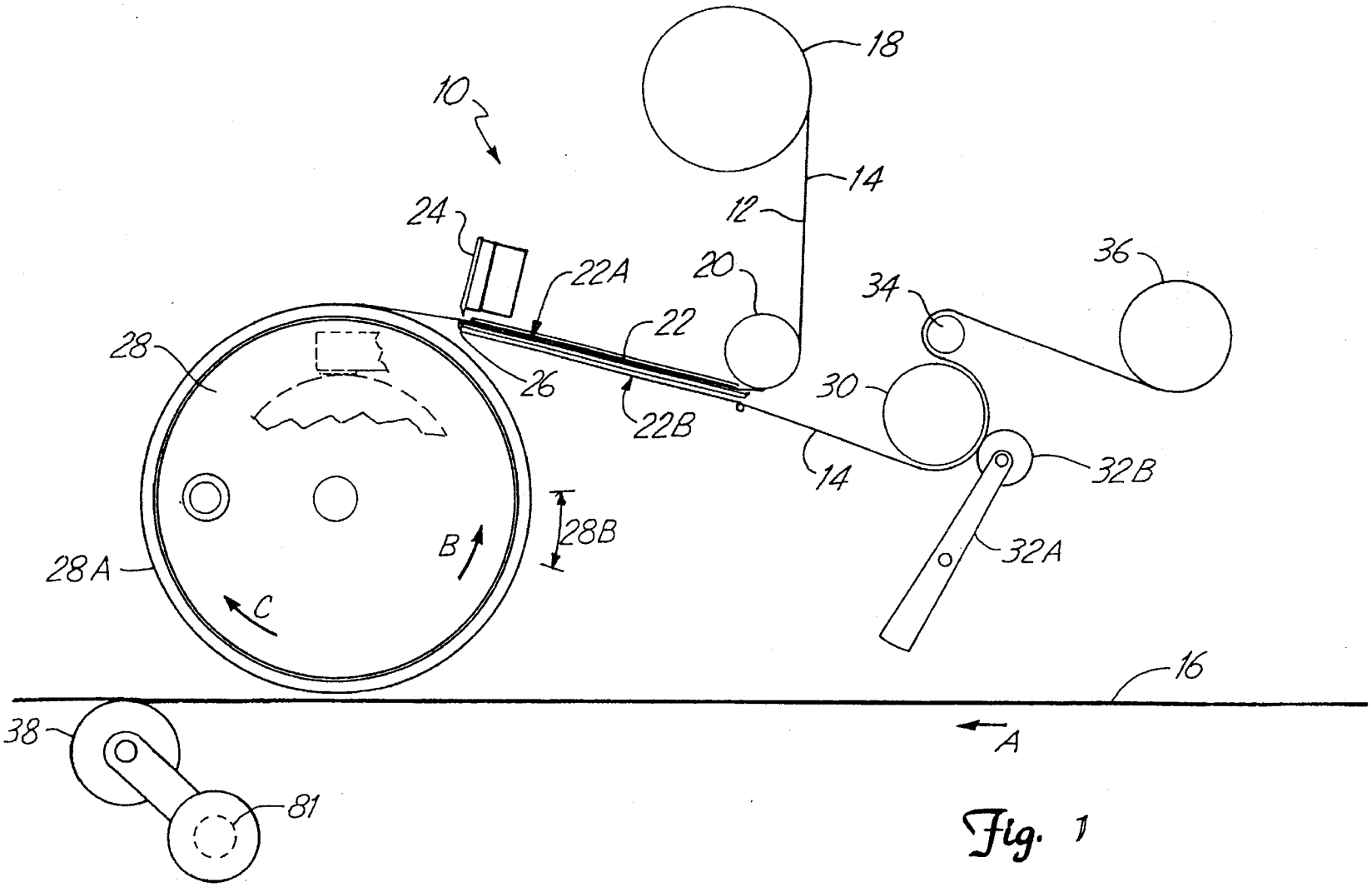
FIG. 1 is a diagrammatic view showing the path of the adhesive tape and the tape liner in the present invention.

FIG. 1 is a diagrammatic view showing one preferred embodiment of high speed rope applicator 10, which has several structural components removed so that the path of adhesive tape 12 and tape liner 14 can be viewed prior to attachment of adhesive tape 12 to web of material 16. High speed tape applicator 10 includes tape supply roller 18, tension roller 20, platform 22 having top surface 22A and bottom surface 22B, knife 24, end 26 of platform 22, vacuum wheel 28, drive roller 30, arm 32A, pressure roller 32B, idler roller 34, tape liner rewind roller 36, jump roller 38, and jump roller drive motor 81.

As shown in FIG. 1, adhesive tape 12 and tape liner 14 are ted from a supply of adhesive tape encompassing tape supply roller 18. However, in other embodiments, adhesive tape 12 and tape liner 14 can be ted from any type of tape dispensing or supply means, such as a conveying platform. In addition, in other embodiments, adhesive tape 12 can be single or double sided tape, and can be of a linerless design.

Adhesive tape 12 and tape liner 14 are fed around tension roller 20 onto top surface 22A of platform 22. At end 26 of platform 22, tape liner 14 is folded back around the small radius of end 26. Adhesive tape 12 is relatively rigid, compared to tape liner 14. As a result, tape liner 14 separates or peels from adhesive tape 12 and adhesive tape 12 advances onto vacuum wheel 28. Adhesive rope 12 advances onto circumfirential portion 28A or vacuum wheel 28, while tape liner 14 is fed onto bottom surface 22B of platform 22. Tape liner 14 continues to be ted between drive roller 30 and pressure roller 32, around idler roller 34, and is eventually wound around tape liner rewind roller 36. However, it is only important that tape liner 14 not interfere with adhesive tape 12 once it has been separated from adhesive tape 12. Thus, it is possible for the present invention to properly operate without rewinding tape liner 14 onto rope liner rewind roller 36.

Knife 24 performs a precision cut and severs at least a portion of adhesive tape 12 once a predetermined length of adhesive tape 12 has passed under knife 24. Tape liner 14 is not severed. The predetermined length of adhesive tape 12 is positioned on circumferential portion 28A of vacuum wheel 28. Circumferential portion 28B remains tape free. Therefore, the predetermined length of adhesive tape 12 should be less than the circumference of vacuum wheel 28.

Web of material 16 is continuously moving at speeds in the range of approximately 250 to 10,000 feet per minute under high speed tape applicator 10 in a direction from right to left shown by arrow A in FIG. 1. While adhesive tape 12 is being applied to circumferential portion 28A of vacuum wheel 28, vacuum wheel 28 is rotating in the direction shown by arrow B. Once the severed strip of adhesive tape 12 has been applied to vacuum wheel 28, the rotation of vacuum wheel 28 in the direction shown by arrow B is stopped. The vacuum wheel is then rotated in the opposite direction shown by arrow C. At a preselected time, jump roller 38 initially forces web of material 16 into contact with circumferential portion 28B of vacuum wheel 28 and adhesive tape 12 is transferred to web of material 16. If jump roller 38 initially forces web of material 16 into contact with circumferential portion 28A of vacuum wheel 28 at a mid-point of the tape strip, :adhesive tape 12 and/or web of material 16 could tear. Therefore, Central Process Unit 56 (shown in FIGS. 3 and 4) monitors information regarding the speed of vacuum wheel 28, the speed of web of material 16, the amount of web of material 16 passing under high speed tape applicator t0 and the precise location which adhesive tape 12 is to be applied, and the time necessary for jump roller 38 to force web of material 16 into contact with vacuum wheel 28 at a leading edge of the tape. Once adhesive tape 12 is transferred to web of material 16, the rotation of vacuum wheel 28 in the direction as shown by arrow C is stopped and the process is complete. However, in other embodiments, vacuum wheel 28 can be rotated in the same direction for both the loading of adhesive tape 12 to vacuum wheel 28 and the applying of adhesive tape 12 to web of material 16.

In other embodiments, jump roller 38 can be replaced by any component having the capability of forcing web of material 16 into contact with vacuum wheel 28. Conversely, jump roller 38 can be eliminated if vacuum wheel 28 has the capability of moving in a downward direction, thus forcing adhesive tape 12 into contact with web of material 16.

Figure 2:
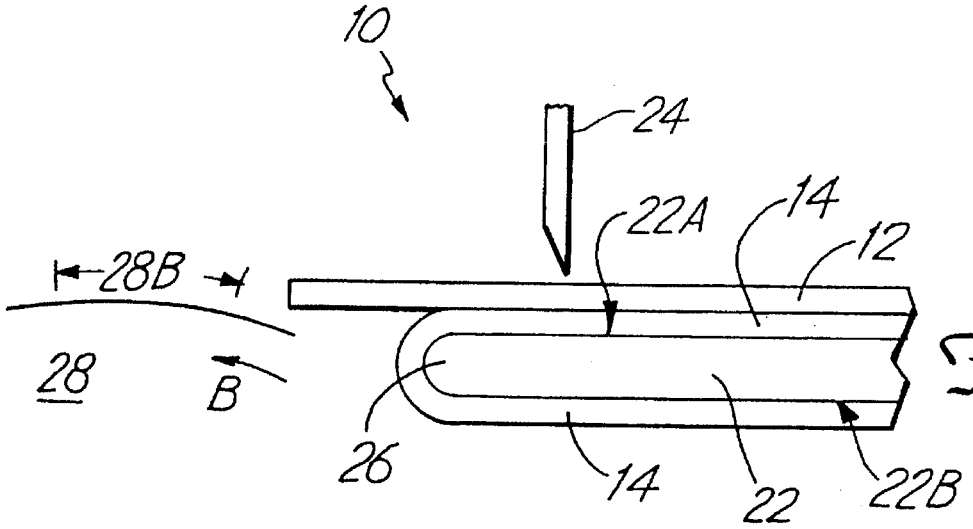
FIG. 2 is an enlarged diagrammatic view showing a portion of the present invention.

FIG. 2 is an enlarged diagrammatic view showing a portion of high speed tape applicator 10. FIG. 2 shows a portion of the paths of adhesive tape 12 and tape liner 14 near end 26 of platform 22. When adhesive tape 12 is being applied to circumferential portion 28A of vacuum wheel 28, vacuum wheel 28 is rotating in the direction as shown by arrow B. Tape liner 14 is forced around the small radius of end 26 of platform 22 and along bottom surface 22B of platform 22. Tape liner 14 is being pressed against drive roller 30 by pressure roller 32 and drive roller 30 is being driven by drive belt 80 (shown in FIG. 4). Once the predetermined length of adhesive tape 12 has passed knife 24, knife 24 performs a precision cut and severs a portion of adhesive tape 12, while tape liner 14 is not severed. The remaining portion of adhesive tape 12 is then fed onto circumferential portion 28A of vacuum wheel 28. The rotation of vacuum wheel 28 in the direction shown by arrow B is then stopped and adhesive tape 12 is ready to be applied to web of material 16 (shown in FIG. 1).

During application of adhesive tape 12 to circumferential portion 28A of vacuum wheel 28, the small radius of end 26 separates tape liner 14 from adhesive tape 12. The relative rigidity of adhesive tape 12 causes the separated end of adhesive tape 12 to travel over the space between end 26 and vacuum wheel 28 to be applied to vacuum wheel 28.

Figure 3:
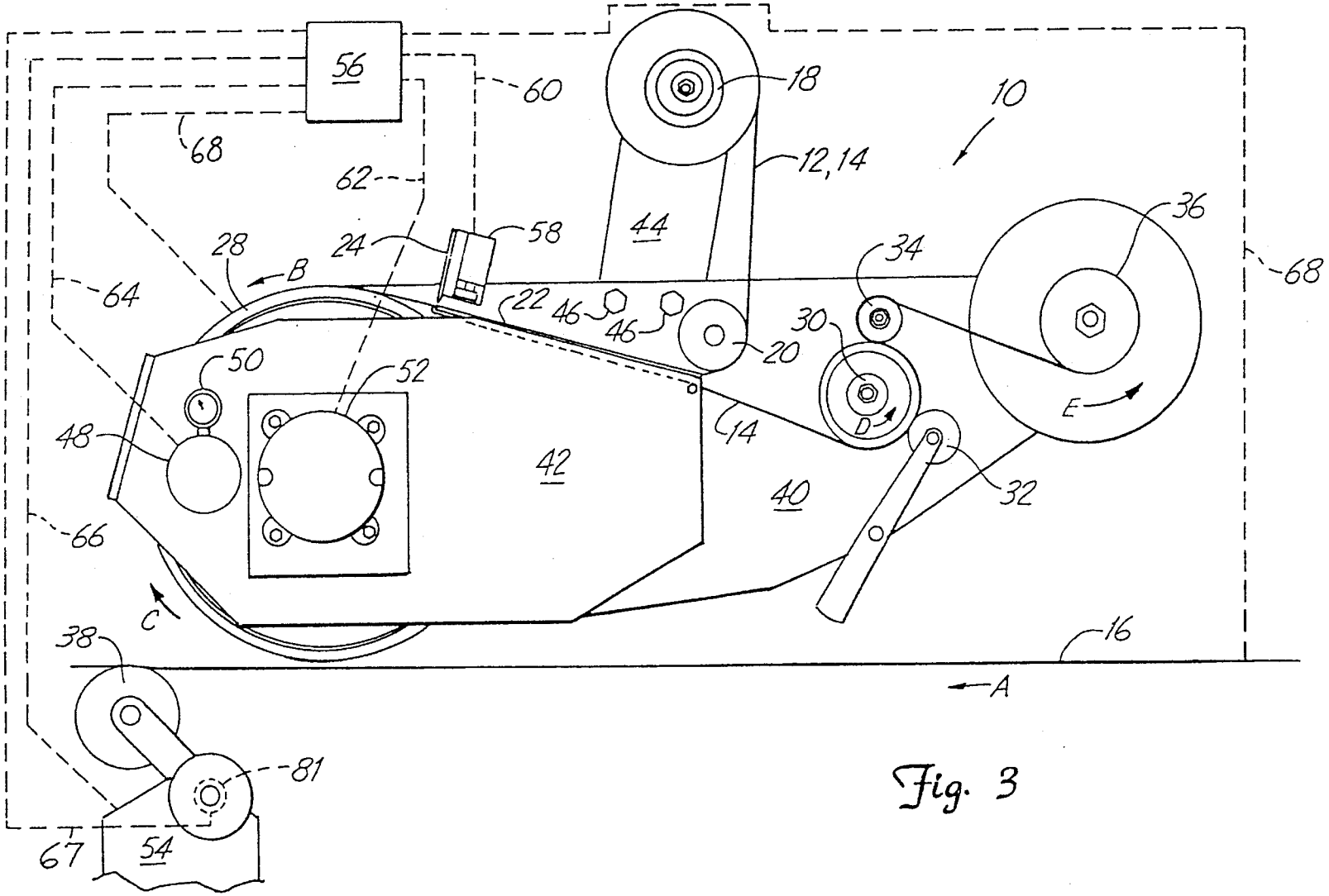
FIG. 3 is a first perspective view showing the present invention.

FIG. 3 is a first perspective view showing high speed tape applicator 10. As shown in FIG. 3, tension roller 20, drive roller 30, pressure roller 32, idler roller 34, and tape liner rewind roller 36 are all connected to base plate 40. Tape supply roller 18 is connected to base plate 40 via arm 44. Arm 44 is attached to base plate 40 by bolts 46. Vacuum wheel 28 is connected between base plate 40 and front plate 42.

Vacuum pump 48 provides the necessary vacuum pressure to circumferential portion 28A of vacuum wheel 28. Circumferential portion 28B does not require a vacuum since no tape is supplied to this portion. The circumferential distances of portions 28A and 28B can be varied depending upon the size requirements of the adhesive tape to be applied. Gauge 50 monitors the vacuum pressure being supplied to circumferential portion 28A of vacuum wheel 28. Motor 52 supplies power to vacuum wheel 28 and rotates vacuum wheel 28 in the direction shown by arrow C once adhesive tape 12 has been applied to circumferential portion 28A of vacuum wheel 28 and is ready to be adhered to web of material 16. Jump roller actuator 54 provides a base for jump roller 38.

Central Process Unit (CPU) 56 is electrically connected to several components of high speed tape applicator 10, including electrical circuitry 58 via communication line 60, motor 52 via communication line 62, vacuum pump 48 via communication line 64, vacuum wheel 28 via communication line 65, jump roller drive motor 81 via communication line 67, jump roller actuator 54 via communication line 66, and web of material 16 via communication line 68. CPU 56 receives information from and sends information to these components during a high speed tape application. Board logic or programmable circuitry could be substituted for CPU 56 as long as the necessary speed requirements are met.

During the loading of adhesive tape 12 onto circumferential portion 28A of vacuum wheel 28, CPU 56 communicates with vacuum pump 48. Also CPU 56 communicates with electrical circuitry 58 such that knife 24 cuts adhesive tape 12 into the proper length.

During the application of adhesive tape 12 to web of material 16, CPU 56 communicates with a variety of components. CPU 56 communicates with web of material 16 via communication line 68 to determine the speed of web of material 16 and to identify the amount of web of material 16 passing under high speed tape applicator 10, such that the strip of adhesive tape 12 can be properly applied to web of material 16. CPU 56 could utilize encoders or other tracking means to determine the amount of material 16 passing under high speed tape applicator 10 and the precise location which adhesive tape 12 is to be applied. CPU 56 also communicates with vacuum wheel 28 to determine both the speed of vacuum wheel 28 and an index point on vacuum wheel 28, preferably representing the center of circumferential portion 28B (the circumferential portion of vacuum wheel 28 without adhesive tape 12 attached thereto). The index point is an imaginary point preferably located at the centerpoint of circumferential portion 28B (the portion where no tape is applied). The location of the index point can vary so long as its location with respect to the tape location is determined and may change with the size of circumferential portion 28B. CPU 56 could also utilize encoders or other tracking means to determine and/or vary the index point on vacuum wheel 28.

CPU 56 communicates with motor 52 to synchronize the speed of vacuum wheel 28 having a strip of adhesive tape attached thereto and web of material 16 so that the two are moving at the same speed. If vacuum wheel 28 and web of material 16 are not synchronized, either adhesive tape 12 or web of material 16 could be damaged during an application. CPU 56 communicates with jump roller actuator 38 and jump roller drive motor 81 such that jump roller actuator 38 causes web of material 16 to initially come into contact with circumferential portion 28B of vacuum wheel 28 so that adhesive tape 12 is properly applied to web of material 16. If jump roller actuator 38 causes web of material 16 to initially come into contact with circumferential portion 28A of vacuum wheel 28, either adhesive tape 12 or web of material 16 could be damaged.

Figure 4:
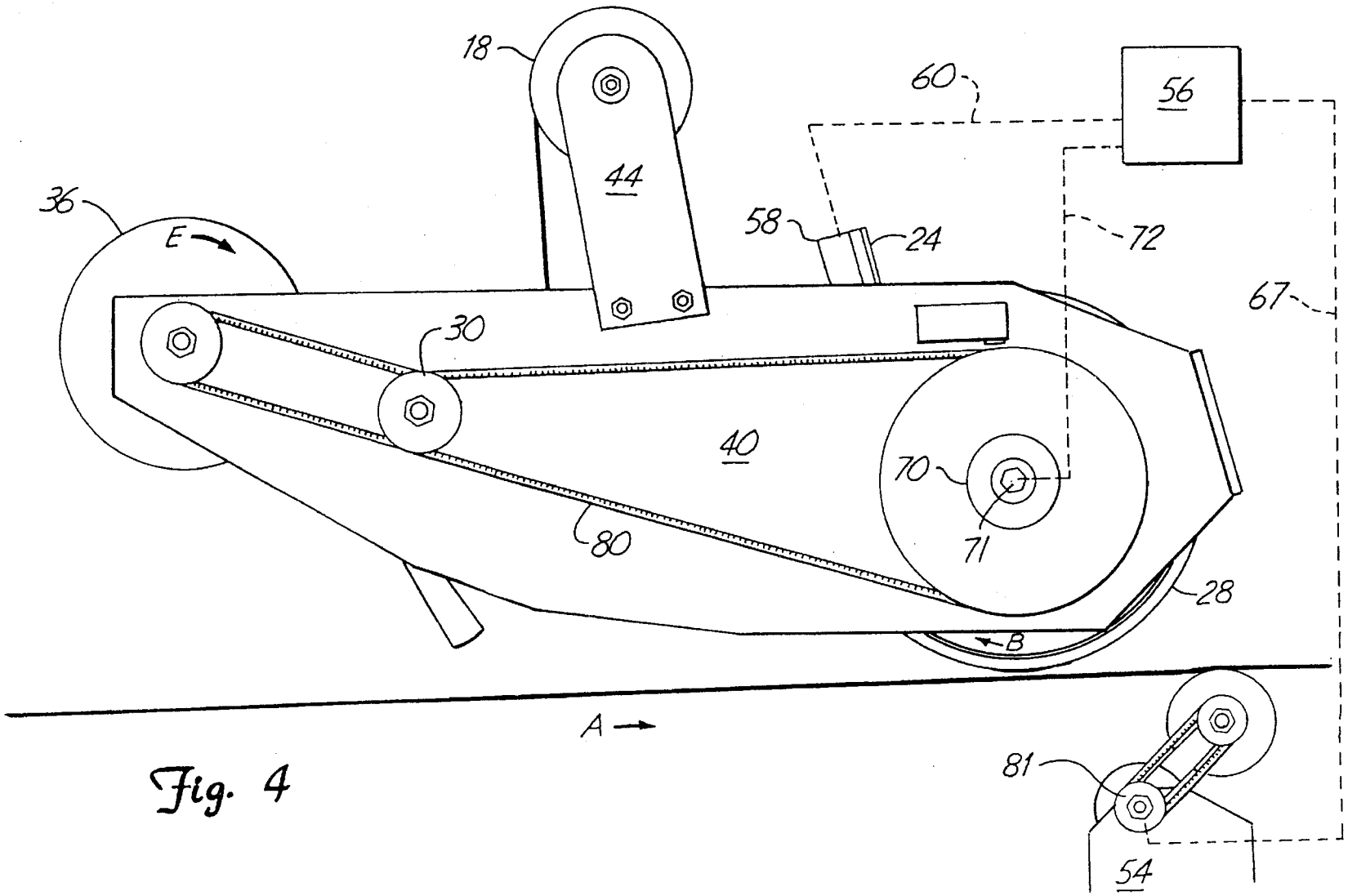
FIG. 4 is a second perspective view showing the present invention.

FIG. 4 is a second perspective view showing the opposite side of high speed applicator 10. As shown in FIG. 4, clutch 70 is connected to shaft 71, about which vacuum wheel 28 is positioned. Clutch 70 is also connected to CPU 56 via communication line 72. Vacuum wheel 28, drive roller 30, and tape liner rewind roller 36 are all interconnected via drive belt 80.

As shown in FIGS. 1–4, the sequence of operations of high speed tape applicator 10 is generally as follows. CPU 56 communicates with vacuum pump 48 causing vacuum pump 48 to supply a vacuum pressure to circumferential portion 28A of vacuum wheel 28. It is not necessary to supply circumferential portion 28B with a vacuum pressure, since no adhesive tape is to be applied to this area. The circumferential surface of vacuum wheel 28 is preferably coated with a non-stick coating to prevent adhesive tape 12 from sticking to vacuum wheel 28. Any conventional release coating can be used for the non-stick coating; examples of which are Teflon and silicon. Therefore, it is necessary for vacuum pump 48 to apply a vacuum pressure to vacuum wheel 28 to insure that adhesive tape 12 is maintained on the circumference of vacuum wheel 28.

In one preferred embodiment vacuum wheel 28 is of the type described in U.S. patent application entitled VACUUM WHEEL APPLICATOR WITH NON-CONTACT MANIFOLD, filed on even date herewith and assigned to the same assignor as the present application, the entire disclosure of which is incorporated herein by reference. A non-contact manifold type applicator is particularly advantageous in that the vacuum wheel 28 can be quickly driven up to speed with minimal resistance and with lower power motors. Such a system utilizes a slight gap between the vacuum wheel and its manifold through which some air leaks, but uses a vacuum source providing a high air flow. The high air flow volume is used to compensate for the loss in static pressure caused by the air leakage. In this regard, it is understood that any slight leakage of air causes a very significant loss of static pressure. The device of the present invention operates at static pressures that are extremely below that of conventional contact manifold vacuum wheels. Contact manifold vacuum wheels typically operate at about 15–25 inches of mercury with air flow volumes of 10 $ft^3$/minute (cfm). The vacuum wheel 28 of the present invention preferably operates at a static pressure of about 78 inches of water at a volume of 95 cfm.

The combination of static pressure and volume contribute to the holding power of the vacuum wheel. The size of the gap affects the holding force and determines the volume needed. The holding power is also affected by the velocity of rotation thereof, the higher the velocity, the greater the centrifugal force which tends to throw the web material from the wheel, and the area of the openings through which the suction is provided to the wheel surface. Moreover, it is noted that particularly in high speed applications, it is desirable to have the web material (tape) accurately provided on the wheel so that the leading edge is very close to a row of openings to prevent that edge from lifting off from the wheel surface during rotations.

In addition, CPU 56 communicates with clutch 70 causing clutch 70 to be engaged, thereby allowing motor 52 to rotate vacuum wheel 28, drive roller 30, and tape liner rewind roller 36 via drive belt 80 in the direction of arrows B, D, and E, respectively. Motor 52 and clutch 70 are connected to shaft 71. Adhesive tape 12 and tape liner 14 are fed around tension roller 20 onto top surface 22A of platform 22. Due to the relative rigidity of adhesive tape 12, adhesive tape 12 is separated from tape liner 14 and is fed onto circumferential portion 28A of vacuum wheel 28 while tape liner 14 is fed around end 26 of platform 22 onto bottom surface 22B of platform 22. Adhesive tape 12 and tape liner 14 are continuously fed until a predetermined length of tape has been red passed knife 24. Adhesive tape 12 passing knife 24 is monitored by CPU 56. Once the predetermined length of adhesive tape 12 has passed knife 24, CPU 56 communicates with knife 24 through electrical circuitry 58 and communication line 60. Knife 24 performs a precision cut and severs at least a portion of adhesive tape 12. In the preferred embodiment, adhesive tape 12 is completely or nearly completely severed; however, tape liner 14 is not severed. Rotation of vacuum wheel 28, drive roller 30, and tape liner rewind roller 36 is continued until the entire length of severed adhesive tape 12 is fed onto circumferential portion 28A of vacuum wheel 28.

During the applying of adhesive tape 12 to circumferential portion 28A of vacuum wheel 28, CPU 56 communicates with clutch 70 causing clutch 70 to be engaged, thereby permitting motor 52 to rotate vacuum wheel 28 in the direction shown by arrow B at a speed of less than approximately 150 feet per minute. In the preferred embodiment, vacuum wheel 28 is rotating in direction shown by arrow B at a speed in the range of approximately 5 to 40 feet per minute.

Vacuum wheel 28 has a circumference of less than approximately 60 inches, with the preferred circumference in the range of approximately 32 to 40 inches. The predetermined length of adhesive tape 12 which is to be applied to vacuum wheel 28 and subsequently applied to web of material 16 must have a length less than the circumference of vacuum wheel 28 so that the predetermined length of adhesive tape 12 will fit onto circumferential portion 28A of vacuum wheel 28. Thus, the length of the predetermined strip of adhesive tape 12 is less than of approximately 60 inches, and preferably in the range of approximately 30 to 40 inches.

Once the predetermined length of adhesive tape 12 is applied to vacuum wheel 28, CPU 56 disengages clutch 70, thereby stopping the rotation of drive roller 30 and tape liner rewind roller 36 in the direction shown by arrows D and E, respectively. At this point, the feed of adhesive tape 12 is completed.

Once clutch 70 is disengaged frown vacuum wheel 28, drive roller 30, and tape liner rewind roller 36, CPU 56 communicates with motor 52 causing motor 52 to rotate vacuum wheel 28 via shaft 71 in the direction shown by arrow C at a very high speed. In the preferred embodiment, vacuum wheel 28 is rotating in the range of approximately 250 to 10,000 feet per minute, and preferably in the range of approximately 1,000 to 7,000 feet per minute. This high rate of speed is identical to the speed of web of material 16 rotating in the direction shown by arrow A under high speed applicator 10. CPU 56 communicates with web of material 16 to determine the exact speed of material 16 and to determine the amount of material 16 passing under high speed tape applicator 10 and the precise location which adhesive tape 12 is to be applied. In other embodiments, vacuum wheel 28 can be rotated in the same direction for both the loading of adhesive tape 12 to vacuum wheel 28 and the applying of adhesive tape 12 to web of material 16.

Immediately before the precise location which adhesive tape 12 is to be applied to web of material 16 reaches vacuum wheel 28, CPU 56 communicates with jump roller 38, which is synchronized with the speed of web of material 16, so that jump roller 38 begins to move web of material 16 towards vacuum wheel 28. In the preferred embodiment, it is approximately 40 to 115 milliseconds from the time jump roller 38 is activated until the time jump roller 38 forces web of material 16 into contact with vacuum wheel 28. Also in the preferred embodiment, the jump roller is lifted by a pressure in the range of approximately 40 to 100 pounds per square inch. When jump roller 38 forces web of material 16 into contact with vacuum wheel 28, web of material 16 must come into contact with circumferential portion 28B of vacuum wheel 28 (ie. at a point where no portion of adhesive tape 12 is attached to vacuum wheel 28). If web of material 16 initially comes into contact with vacuum wheel 28 in the middle of adhesive tape 12, either adhesive tape 12 or web of material 16 could tear and be destroyed. Therefore, CPU 56 monitors both the index point locating adhesive tape 12 on vacuum wheel 28 and the speed of web of material 16 such that CPU 56 activates jump roller 38 at the proper time to ensure that it will force web of material 16 into contact with circumferential portion 28B of vacuum wheel 28 (ie. in the gap between the two ends of adhesive tape 12). This will allow a leading edge of the strip of adhesive tape to be applied to web of material 16 first and will prevent damage to either adhesive tape 12 or web of material 16.

Once adhesive tape 12 has been applied to web of material 16, CPU 56 disengages jump roller 38 and stops both vacuum 48 and motor 52. The application of adhesive tape 12 to web of material 16 is complete.

Although the present invention has been described with reference to preferred embodiments, workers skilled in the art will recognize that changes may be made in form and detail without departing from the spirit and scope of the invention.

What is claimed is:

1. An apparatus for applying adhesive tape to a moving web of material, the apparatus comprising:

tape dispensing means for supplying the adhesive tape;

drive means for driving the adhesive tape;

cutting means moving substantially perpendicular to a direction of the adhesive tape for cutting at least a portion of the adhesive tape into a strip of tape, the strip of tape having a predetermined length;

a vacuum wheel having a tape receiving portion and a tape free portion, wherein the tape receiving portion receives the strip of tape while the vacuum wheel is moving in a first direction, and wherein the vacuum wheel supplies the strip of tape to the moving web of material while moving in a second direction, opposite to the first direction; and applying means for forcing the moving web of material from a base position juxtaposed the vacuum wheel to an applying position in contact with the tape free portion of the vacuum wheel such that the strip of tape is transferred to the web of material.

2. The apparatus of claim 1 and further comprising:

a tension roller for maintaining a substantially constant tension in the adhesive tape.

3. The apparatus of claim I wherein the applying means further comprises a jump roller.

4. The apparatus of claim 1 wherein the adhesive tape is adhered to a tape liner.

5. The apparatus of claim 4 and further comprising:

a liner rewind for receiving the tape liner.

6. The apparatus of claim 4 and further comprising:

separating means for separating the adhesive tape from the tape liner.

7. The apparatus of claim 1 and further comprising:

a clutch connected to the vacuum wheel and the driver means for permitting the vacuum wheel and the driver means to rotate in the first direction while the adhesive tape is being applied to the tape receiving portion of the vacuum wheel.

8. The apparatus of claim 7 and further comprising:

a motor connected to the vacuum wheel for driving the vacuum wheel in the first direction and for driving the vacuum wheel in the second direction, opposite to the first direction, after the strip of tape has been applied to the tape receiving portion of the vacuum wheel.

9. The apparatus of claim 8 and further comprising:

a central process unit for monitoring the location of a first end of the moving web of material.

10. The apparatus of claim 9 wherein the central process unit monitors a vacuum wheel pressure within the vacuum wheel and a location of the strip of tape on the vacuum wheel, and controls the motor connected to the vacuum wheel, the clutch, the jump roller, and the cutting means.

11. The apparatus of claim 1 wherein the vacuum wheel has a circumference of less than of approximately 60 inches.

12. The apparatus of claim 11 wherein the vacuum wheel has a circumference in the range of approximately 32 to 40 inches.

13. The apparatus of claim 1 wherein the cutting means cuts the adhesive tape into a strip of tape having a length of less than approximately 60 inches.

14. The apparatus of claim 13 wherein the cutting means cuts the adhesive tape into a strip of tape having a length of less than approximately 40 inches.

15. The apparatus of claim 1 wherein the vacuum wheel is coated with a nonstick coating to prevent the strip of tape from sticking to the vacuum wheel.

16. The apparatus of claim 1 wherein a pressure in the range of approximately 40 to 100 pounds per square inch lifts the jump roller, thereby forcing the moving web of material into contact with the tape free portion of the vacuum wheel.

17. The apparatus of claim 16 wherein the jump roller is lifted in a time period having the range of approximately 40 to 115 milliseconds, thereby forcing the moving web of material into contact with the tape free portion of the vacuum wheel.

18. A method of applying adhesive tape to a moving web of material, the method comprising:

cutting a strip of adhesive tape having a predetermined length from a roll of adhesive tape;

applying the strip of tape to a tape receiving portion of a vacuum wheel with respect to a reference point located in a tape free portion of the vacuum wheel while the vacuum wheel is rotating in a first direction;

rotating the vacuum wheel in a second direction, opposite to the first direction, at a predetermined speed approximately equal to a speed of the moving web of material;

monitoring the reference point on the vacuum wheel; and bringing the web of material into contact with the tape free portion of the vacuum wheel, thereby applying the strip of tape to the web of material.

19. The method of claim 18 wherein the step of applying the strip of tape further comprises:

applying the strip of tape to a vacuum wheel at a speed of less than 150 feet per minute.

20. The method of claim 18 wherein the predetermined speed is in the range of approximately 250 to 10,000 feet per minute.

21. The method of claim 20 wherein the predetermined speed is in the range of approximately 1,000 to 7,000 feet per minute.

22. The method of claim 18 and further comprising:

monitoring the speed of the moving web of material; and rotating the vacuum wheel at a speed substantially equal to the speed of the moving web of material.

23. The method of claim 18 and further comprising:

monitoring an amount of material passing under the vacuum wheel; and applying the strip of tape to a specific point on the web of material.

24. The method of claim 18 and further comprising:

creating a vacuum in an interior of the vacuum wheel causing a suction force at an exterior surface of the vacuum wheel, wherein the suction force maintains the strip of tape on the vacuum wheel.

25. The method of claim 24 and further comprising:

disengaging the moving web of material from the vacuum wheel;

stopping the vacuum in the interior surface of the vacuum wheel; and stopping the rotation of the vacuum wheel in the second direction.

26. An apparatus for applying adhesive tape to a moving web of material, the apparatus comprising:

feed means for feeding adhesive tape at a substantially constant tension;

cutting means moving substantially perpendicular to a direction of the adhesive tape for cutting a trailing edge of the adhesive tape, thereby forming a strip of adhesive tape;

a vacuum wheel having at tape receiving portion for receiving the strip of adhesive tape and a tape free portion, wherein the vacuum wheel is moving in a first direction when receiving the strip of adhesive tape; and transferring means for transferring the adhesive tape from the tape receiving portion of the vacuum wheel to the moving web of material, wherein the vacuum wheel is moving in a second direction opposite to the first direction.

27. The apparatus of claim 26 wherein the adhesive tape is adhered to a tape liner.

28. The apparatus of claim 27 and further comprising:

separating means for separating the tape liner from the adhesive tape.

29. The apparatus of claim 26 wherein the vacuum wheel has a circumference of less than approximately 60 inches.

30. The apparatus of claim 29 wherein the vacuum wheel has a circumference in the range of approximately 30 to 40 inches.

31. The apparatus of claim 26 wherein the cutting means cuts the adhesive tape into a strip of tape having a length of less than approximately 60 inches.

32. The apparatus of claim 31 wherein the cutting means cuts the adhesive tape into a strip of tape having a length in the range of approximately 30 to 40 inches.

33. The apparatus of claim 26 wherein the vacuum wheel is coated with a nonstick coating to prevent the strip of tape from sticking to the vacuum wheel.

34. A process of applying adhesive tape to a moving web of material, the process comprising:

feeding adhesive tape adhered to a tape liner at a substantially constant tension;

cutting the adhesive tape to form a strip of adhesive tape;

separating the tape liner from the adhesive tape;

applying the strip of adhesive tape to a tape receiving portion of the vacuum wheel while the vacuum wheel is rotating in a first direction; and transferring the strip of adhesive tape from the vacuum wheel to the moving web of material while the vacuum wheel is rotating in a second direction, opposite to the first direction.

* * * * *

UNITED STATES PATENT AND TRADEMARK OFFICE

CERTIFICATE OF CORRECTION

PATENT NO. : 5,482,593

DATED : January 9, 1996

INVENTOR(S) : GARY K. KUHN; HERBERT A. MCLEES

It is certified that error appears in the above-indentified patent and that said Letters Patent is hereby corrected as shown below:

Col. 2, line 6, delete "teed", insert --feed--

Col. 2, line 67, delete "rope", insert --tape--

Col. 3, line 11, delete "ted'", insert --fed--

Col. 3, line 24, delete "circumfirential", insert --circumferential--

Col. 3, line 26, delete "ted", insert --fed--

Col. 3, line 33, delete "rope", insert --tape--

Col. 3, line 58, delete ":", before "adhesive"

Col. 3, line 63, delete "t", insert --1--

Col. 5, line 42, delete "." before "jump"

Col. 6, line 55, delete "red", insert --fed--

Col. 8, line 38, delete "I", insert --1--

Signed and Sealed this

Ninth Day of April, 1996

Bruce Lehman

*Attest:*

BRUCE LEHMAN

*Attesting Officer*

*Commissioner of Patents and Trademarks*